United States Patent [19]

Sakurai

[11] Patent Number: 4,469,053

[45] Date of Patent: Sep. 4, 1984

[54] AUTOMOTIVE ELECTRIC FAN CONTROLLING DEVICE

[75] Inventor: Yukio Sakurai, Atsugi, Japan

[73] Assignee: Nissan Motor Company, Limited, Yokohama, Japan

[21] Appl. No.: 448,763

[22] Filed: Dec. 10, 1982

[30] Foreign Application Priority Data

Jan. 13, 1982 [JP] Japan ..... 57-2867

[51] Int. Cl.[3] ..... F01P 7/12

[52] U.S. Cl. ..... 123/41.12

[58] Field of Search ..... 123/41.11, 41.12, 41.48, 123/41.49; 236/35, DIG. 9

[56] References Cited

U.S. PATENT DOCUMENTS

| | | | |
|---|---|---|---|
| 2,523,404 | 9/1950 | Wallace | 123/41.11 |
| 4,257,554 | 3/1981 | Willingham | 123/41.12 |
| 4,325,330 | 4/1982 | Kugler et al. | 123/41.12 |

FOREIGN PATENT DOCUMENTS 2010966 7/1979 United Kingdom .

*Primary Examiner*—William A. Cuchlinski, Jr.
*Attorney, Agent, or Firm*—Schwartz, Jeffery, Schwaab, Mack, Blumenthal & Koch

[57] ABSTRACT

In an automotive electric fan controlling device, means is provided for interrupting the rotation of the electric fan when the running speed of the motor vehicle exceeds a predetermined level.

4 Claims, 8 Drawing Figures

AUTOMOTIVE ELECTRIC FAN CONTROLLING DEVICE

BACKGROUND OF THE INVENTION

1. Field of the Invention

The present invention relates to an electric fan adapted for forcibly cooling a radiator by energizing a fan motor when the temperature of engine cooling water is elevated, and more particularly it pertains to an automotive electric fan controlling device which is so designed as to interrupt the energization of the fan motor when the speed of air flow through the radiator when the motor vehicle is running, becomes higher than a predetermined speed, thereby minimizing consumption of battery power.

2. Description of the Prior Art

In order to have a better understanding of the present invention, reference will first be made to FIG. 1 which illustrates a conventional device for controlling an electric fan adapted for cooling a radiator. In the illustrated conventional device, a fan motor 5 for the electric fan 4 is supplied with electric power from a battery through an ignition switch 1 and a thermo-switch 3 which is turned on when the temperature of engine cooling water passed to the radiator 2 is higher than a predetermined value. More specifically, in case the engine cooling water temperature becomes higher than the predetermined value, the thermo-switch 3 is turned on so that the fan motor 5 is energized to cause the electric fan 4 to be rotated, whereby the radiator 2 is forcibly cooled and thus the engine cooling water temperature is prevented from being elevated.

Such a conventional device for forcibly cooling the radiator by means of the electric fan is suitably employed with a front-engine, front drive (FF) type motor vehicle, and is able to positively avoid overheating of the engine by virtue of the face that the electric fan 4 is rotated only when the engine cooling water temperature becomes higher than the aforementioned predetermined value.

Since the speed of rotation of the electric fan 4 effected by the fan motor 5 is substantially constant, the speed (shown at A in FIG. 2) of air flow produced at the front face of the radiator when the motor vehicle is running with the electric fan 4 being stopped, becomes substantially equal to the speed (shown at B in FIG. 2) of air flow produced at the front face of the radiator when the motor vehicle is running with the electric fan 4 being rotated, in the case where the running speed of the motor vehicle is increased to a certain extent.

Thus, when the running speed of the motor vehicle is higher than a predetermined speed, the speed of air flow introduced into the radiator 2 due to the motor vehicle running is higher than the speed of air flow sucked in through the radiator due to the rotation of the electric fan effected by the fan motor 5 which is energized upon closure of the thermo-switch 3. This means that the cooling effect produced by passing cooling air through the radiator 2 by means of the electric fan 4 is less in such a case; in other words, even if the electric fan 4 is stopped, cooling effect for the radiator 2 substantially equivalent to that produced when the electric fan 4 is rotated, can be achieved by the air flow produced due to the motor vehicle running. As mentioned above, in the foregoing conventional device, the electric fan 4, which consumes a relatively large proportion of battery power, is continuously driven irrespective of the running speed of the motor vehicle; thus the conventional device is disadvantageous in that battery power is wastefully consumed.

SUMMARY OF THE INVENTION

Accordingly, it is an object of the invention to provide a novel and improved automotive electric fan controlling device which is free from the drawbacks of the aforementioned conventional device.

Another object of the present invention is to provide a novel and improved automotive electric fan controlling device adapted for forcibly cooling a radiator by driving a fan motor when the temperature of the engine cooling water becomes higher than a predetermined value, the device comprising means for stopping the fan motor from being driven when the speed of air flow introduced in the radiator when the motor vehicle is running, becomes higher than a predetermined level, thereby minimizing battery power consumption.

Other objects, features and advantages of the present invention will become apparent from the ensuing description taken in conjunction with the accompanying drawings.

DESCRIPTION OF THE PREFERRED EMBODIMENTS

Figure 1:
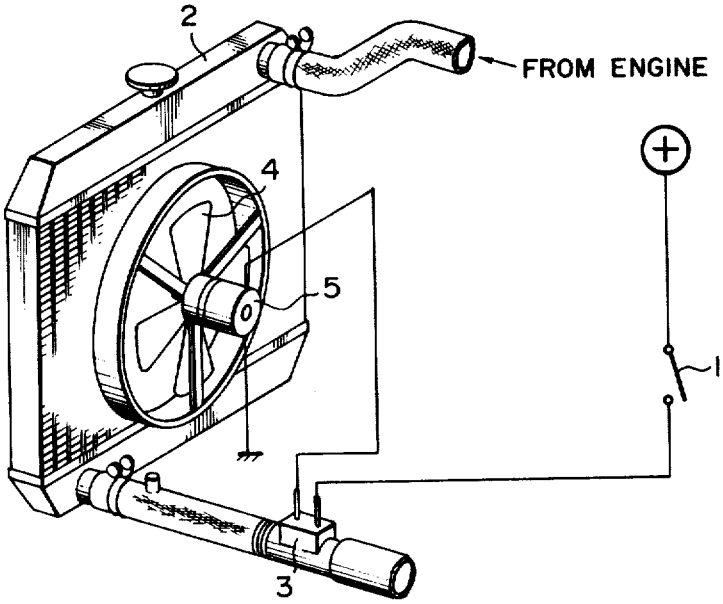
FIG. 1 PRIOR ART
FIG. 1 is a schematic perspective view showing an example of the conventional automotive electric fan controlling device.
Figure 2:
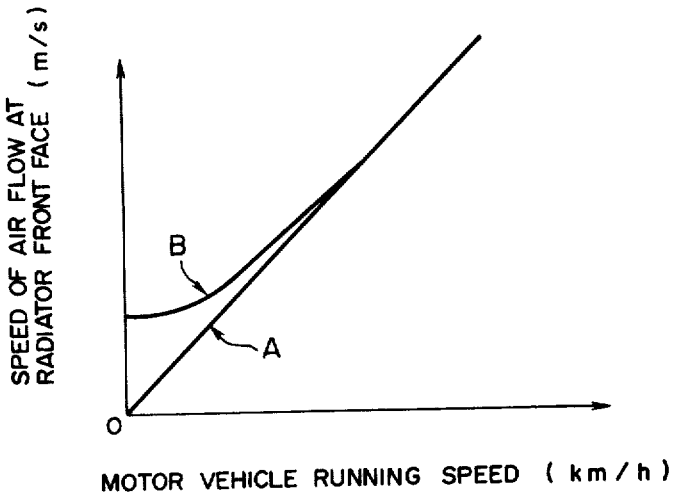
FIG. 2 is a graph showing how the speed of air flow produced at the front face of a radiator when the motor vehicle is running with the electric fan being rotated and the speed of air flow which is produced at the front fact of the radiator when the motor vehicle is running with the electric fan being stopped, vary with the running speed of the motor vehicle.
Figure 3:
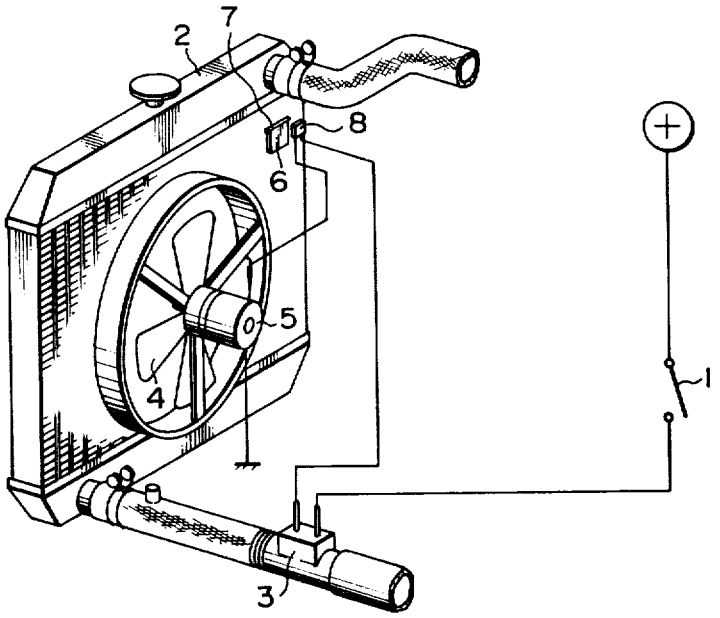
FIG. 3 is a schematic perspective view showing the automotive electric fan controlling device according to an embodiment of the present invention.

Referring to FIG. 3 of the drawings, there is shown the automotive electric fan controlling device according to an embodiment of the present invention, wherein elements similar to those of FIG. 1 are indicated by like reference numerals. In this embodiment, an electric fan 4, which is driven by a fan motor 5, is provided at the back of a radiator 2. Means for detecting the speed of air flow passing through the radiator 2 when the motor vehicle is running, is provided which comprises a flap 6 of a plastic material which is pivotally mounted at the upper edge thereof on a shaft 7 at a predetermined position in a corner at the back of the radiator 2. A ram pressure detecting switch is provided which is adapted to be turned off by being contacted by the flap 6 when the latter is turned through a predetermined angle by the aforementioned air flow passing through the radiator 2 when the motor vehicle is running. It is also possible that the ram pressure detecting switch 8 may be turned off by being contacted by an arm or the like mounted on the shaft 7, instead of by being contacted by the flap 6 as mentioned above. A power source such as a battery is connected in such a manner that power is supplied to the fan motor 5 for the electric fan 4 through an ignition switch 1, a thermo-switch 3 adapted to be turned on when the temperature of engine cooling water is elevated above a predetermined value, and the normally closed ram pressure detecting switch 8 which is adapted to be turned on when the flap 6 is turned through the aforementioned predetermined angle as mentioned above.

Description will now be made of the operation of the embodiment shown in FIG. 3.

Figure 4:
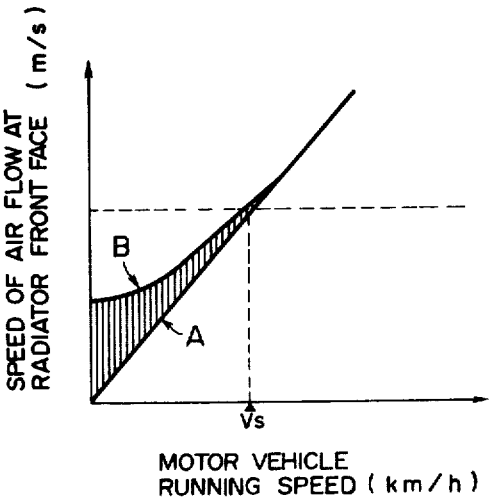
FIG. 4 is a graph showing how the speed of air flow produced at the front face of a radiator when the motor vehicle is running with the electric fan being rotated and the speed of air flow produced when the motor vehicle is running with the electric fan being stopped, vary with the running speed of the motor vehicle, in the embodiment of FIG. 3.
Figure 5:
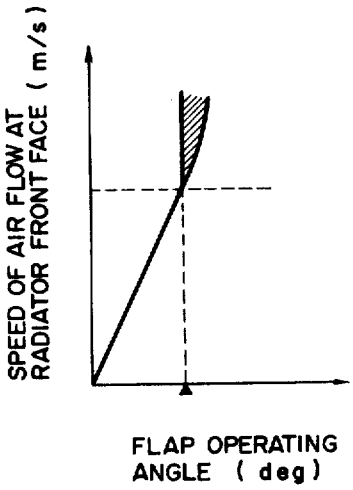
FIG. 5 is a graph showing the relationship between the speed of air flow at the front face of the radiator when the motor vehicle is running and the operating angle of a flap, in the embodiment of FIG. 3.

FIG. 4 shows how the speed of air flow which is produced at the front face of the radiator 2 when the motor vehicle is running with the electric fan 4 being driven and the speed of air flow which is produced at the front face of the radiator 2 when the motor vehicle is running with the electric fan 4 stopped, vary with the running speed of the motor vehicle, in the embodiment shown in FIG. 3. FIG. 5 illustrates the relationship between the speed of air flow at the front face of the radiator and the operating angle of the flap 6. The ram pressure detecting switch 8 is preset so as to be turned off when the operating angle of the flap 6 shown in FIG. 5 corresponds to the motor vehicle's running speed $V_s$ with which the speed (shown at A in FIG. 4) of air flow at the front face of the radiator when the electric fan 4 is being driven by the fan motor 5, becomes substantially equal to the speed (shown at B in FIG. 4) of air flow at the front face of the radiator when the electric fan 4 is not being driven by the fan motor 5.

Thus, in case the thermo-switch 3 is turned on as the result of the engine cooling water temperature having become higher than the predetermined value, and in case the running speed of the motor vehicle is increased higher than the aforementioned speed $V_s$ while the motor fan 4 is being rotated by means of the fan motor 5 which is energized through the ram pressure detecting switch 8 which is in the on state, then the flap 6 will be pivotally moved, by the pressure of the air flow which has been produced as the consequence of the motor vehicle running and passed through the radiator 2, so as to be disposed into contact with the ram pressure detecting switch 8 which will in turn be opened so that the energization of the fan motor 5 will be interrupted and thus the electric fan 4 will be stopped. As will be appreciated, since the electric fan 4 is stopped when the running speed of the motor vehicle becomes higher than the predetermined speed as mentioned above, it is possible to reduce battery power consumption correspondingly.

Although in the embodiment of FIG. 3, the speed of air flow was detected by causing the ram pressure detecting switch 8 to be turned off by means of the flap 6 which is actuated by the pressure of air flow produced at the front face of the radiator when the motor vehicle is running, it is also possible that power supply to the fan motor 5 for the electric fan 4 may be interrupted when the running speed of the motor vehicle, which is detected by means of a motor vehicle running speed sensor, becomes higher than the aforementioned speed $V_s$, by virtue of the fact that a predetermined proportional relationship exists between the running speed of the motqr vehicle and the speed of air flow which is produced at the front face of the radiator when the motor vehicle is running.

Figure 6:
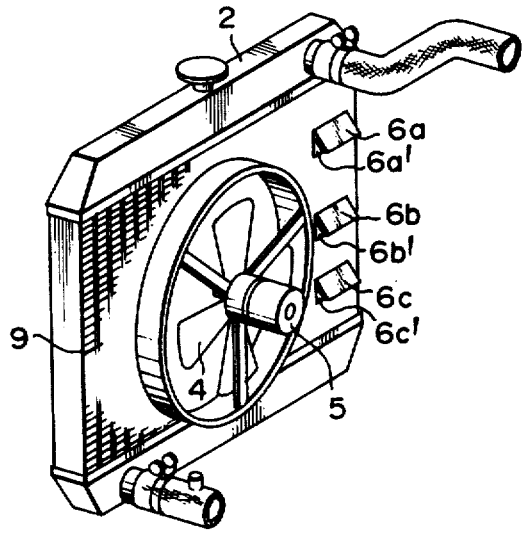
FIG. 6 is a schematic perspective view showing a second embodiment of the present invention.
Figure 7:
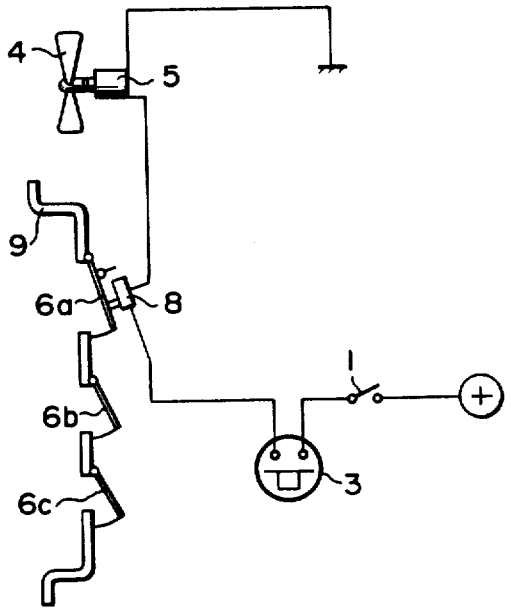
FIG. 7 is a diagram showing the disposition of a ram pressure detecting switch and an electric circuit arrangement associated therewith.

Referring to FIG. 6, there is shown a second embodiment of the present invention, wherein a plurality of flaps **6*a*, 6*b* and 6*c* are pivotally mounted by means of hinges of the like (not shown) on a shroud 9 provided at the back of the radiator 2, each of the flaps being arranged to be pivotally moved to permit air flow, which is produced at the front face of the radiator when the motor vehicle is running, to pass through openings 6*a*', 6*b*' and 6*c*' formed in the shround 9 at positions corresponding to the flaps 6*a*, 6*b* and 6*c* respectively. Further, a ram pressure detecting switch 8 is provided which is arranged to be turned off by any one of the flaps 6*a* to 6*c*, say the uppermost flap 6*a* as shown in FIG. 7 when the flap is turned through a predetermined operating angle by the pressure of the air flow occurring at the front face of the radiator when the motor vehicle is running. A fan motor 5 for an electric fan 4 is supplied with electric power from a power source such as battery through a series connection of an ignition switch 1, a thermo-switch 6 and the ram pressure detecting switch 8**.

In operation, as in the embodiment of FIG. 3, when the motor vehicle's running speed is increased to be higher than a predetermined speed, the flap **6*a* is turned in the opening direction in response to the pressure of the air flow occurring at the front face of the radiator, and the ram pressure detecting switch 8 is turned off by the flap 6*a* so that the power supply to the fan motor 5 from the battery is interrupted, thus resulting in the electric fan 4 being stopped. When the motor vehicle is running at a high speed, each of the flaps 6*a* to 6*c* is opened so that paths for cooling air flow through the radiator 2 are established, and thus the radiator 2 is more effectively cooled by the air flow occurring at the front face thereof. When the speed of the air flow at the front face of the radiator is low as in the case where the motor vehicle engine is idling, for example, all the flaps 6*a* to 6*c* are closed so that hot air flow which tends to be directed from the engine toward the radiator 2 is prevented from reaching the radiatior 2**, and in this way it is possible to prevent the cooling effect for the radiator from being decreased when the motor vehicle engine is idling.

Figure 8:
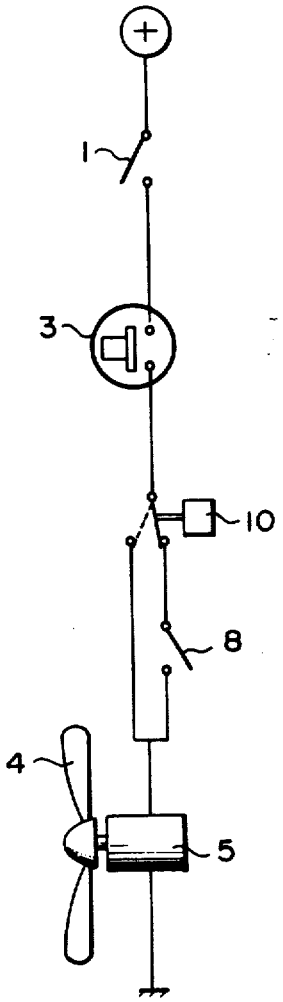
FIG. 8 is a schematic perspective view showing a third embodiment of the present invention.

Referring to FIG. 8, there is shown a circuit connection diagram of a third embodiment of the present invention, which is designed such that when the atmospheric temperature is higher than a predetermined value, electric power can be supplied to a fan motor 5 for an electric fan 4 even if a ram pressure detecting switch 8 is turned off.

In some types of motor vehicle, it is required that even when the motor vehicle is running at a high speed with which the cooling effect produced by the electric fan is relatively small or nil, the electric fan be made to continue rotating in the case where the atmospheric temperature is higher than a predetermined value, thereby producing an enhanced cooling effect for the radiator. To this end, according to this embodiment, an atmospheric temperature detecting switch 10 is provided just before the ram pressure detecting switch 8. More specifically, when the atmospheric temperature is lower than the predetermined value, the atmospheric temperature detecting switch 10 is switched to a contact connected to the ram pressure detecting switch 8 as shown in a solid line in FIG. 8, the ram pressure detecting switch 8 being opened when the motor vehicle is running at a speed higher than the predetermined speed, so that power supply to the fan motor 5 for the electric fan 4 is interrupted, while when the atmospheric temperature is higher than the predetermined value, the atmospheric temperature detecting switch 10 is switched to another contact as shown by a dashed line in FIG. 8 so that the ram pressure detecting switch 8 is by-passed; thus even if the ram pressure detecting switch 8 is turned off, the electric fan 4 continues being rotated by the fan motor 5.

In the foregoing embodiments, the present invention was applied to control an electric fan for cooling a radiator, it will readily be appreciated that the present invention is equally applicable in an attempt to control an electric fan or the like for a radiator condenser in an automotive air conditioner.

As will be appreciated from the foregoing discussion, according to the present invention, in a device for cooling a radiator by energizing a fan motor when the temperature of the radiator cooling water is higher than a predetermined value, the design is made such that the fan motor is not energized even if the cooling water temperature becomes higher than the predetermined value in the case where the speed of air flowing in the radiator when the motor vehicle running speed is higher than a predetermined speed, so that the radiator is cooled by only the air caused to flow through the radiator due to the motor vehicle running when the motor vehicle is running at a such a high speed that the cooling effect of the electric fan becomes relatively neglegible. In this way, it is possible to save battery power. Furthermore, since the total running time of the fan motor is shortened, it is also possible to increase the life span of the fan motor.

While the present invention has been described and illustrated with respect to specific embodiments thereof, it is to be understood that the present invention is by no means limited thereto but covers all changes and modifications which will become possible within the scope of the appended claims.

What is claimed is:

1. A device for controlling an automotive electric fan driven by a fan motor energized by a battery, comprising:

thermo-switch means for permitting energization of said fan motor by said battery so that said electric fan is driven by said fan motor when a temperature of motor vehicle engine cooling water becomes higher than a predetermined value, thereby forcibly cooling a radiator for a motor vehicle engine; and control means for interrupting the energization of said fan motor by said battery so that said electric fan is stopped when the running speed of the motor vehicle becomes higher than a predetermined level, said control means comprising detector means for detecting the speed of air flow introduced in said radiator when said motor vehicle is running; and switch means adapted to be turned off in response to said detector means when the speed of said air flow becomes higher than a predetermined level corresponding to said predetermined level of the motor vehicle running speed, thereby interrupting the energization of said fan motor by said battery;

said detector means comprising a flap pivotally mounted at the back of said radiator, and an opening formed at the back of the radiator in opposing relationship to said flap and in communication with the front face of said radiator, said flap being adapted to be pivotally moved through a predetermined angle, in response to the pressure of said air flow passing through said opening, when the running speed of said motor vehicle reaches said predetermined level; and said switch means comprising a normally closed switch adapted to be turned off by said flap when said flap is pivotally moved through said predetermined angle.

2. A device as set forth.in claim 1, wherein said control means includes means adapted, even when said switch means is turned off, to permit of the energization of said fan motor by said battery so that said electric fan is driven by said fan motor when the atmospheric temperature is higher than a predetermined value.

3. A device for controlling an automotive electric fan driven by a fan motor energized by a battery, comprising:

thermo-switch means for permitting the energization of said fan motor by said battery so that said electric fan is driven by said fan motor when the temperature of motor vehicle engine cooling water becomes higher than a predetermined value, thereby forcibly cooling a radiator for the motor vehicle;

control means for interrupting the energization of said fan motor by said battery so that said electric fan is stopped when the running speed of the motor vehicle becomes higher than a predetermined level, said control means comprising detector means for detecting the speed of air flow introduced in said radiator when said motor vehicle is running, and switch means adapted to be turned off in response to said detector means when the speed of said air flow becomes higher than a predetermined level corresponding to said predetermined level of the motor vehicle running speed, thereby interrupting the energization of said fan motor by said battery;

a plurality of flaps each pivotally mounted at the back of said radiator; and a plurality of openings, equal in number to said flaps, formed at the back of said radiator in opposing relationship to said flaps, respectively, and in communication with the front face of said radiator;

said flaps being adapted to be pivotally moved, in response to the pressure of said air flow passing through said openings, when the running speed of said motor vehicle reaches said predetermined level;

said detector means comprising one of said flaps and associated one of said openings; and said switch means comprising a normally closed switch adapted to be turned off by said one flap when said one flap is pivotally moved through said predetermined angle.

4. A device as set forth in claim 3, wherein said control means includes means adapted, even when said switch means is turned off, to permit of the energization of said fan motor by said battery so that said electric fan is driven by said fan motor when the atmospheric temperature is higher than a predetermined value.

* * * * *